US007632116B2

(12) United States Patent
Lee et al.

(10) Patent No.: US 7,632,116 B2
(45) Date of Patent: Dec. 15, 2009

(54) CONNECTOR WITH AN ELASTIC LEVER

(75) Inventors: Chul-Sub Lee, Daegu (KR); Kun-Taek Lim, Kyungsangbuk-Do (KR); Gi-Chan Kwon, Kyungsangbuk-Do (KR)

(73) Assignee: Tyco Electronics AMP Korea Ltd., Kyungsangbuk-do (KR)

( * ) Notice: Subject to any disclaimer, the term of this patent is extended or adjusted under 35 U.S.C. 154(b) by 0 days.

(21) Appl. No.: 12/029,852

(22) Filed: Feb. 12, 2008

(65) Prior Publication Data

US 2008/0194135 A1 Aug. 14, 2008

(30) Foreign Application Priority Data

Feb. 12, 2007 (KR) ..... 10-2007-0014475

(51) Int. Cl.
*H01R 13/62* (2006.01)

(52) U.S. Cl. ..... 439/157; 439/372

(58) Field of Classification Search ..... 439/157, 439/372

See application file for complete search history.

(56) References Cited

U.S. PATENT DOCUMENTS 5,169,327 A * 12/1992 Hatagishi ..... 439/157
5,478,251 A * 12/1995 Jaklin ..... 439/157
5,888,080 A * 3/1999 Maejima ..... 439/157
7,416,425 B2 * 8/2008 Murakami et al. ..... 439/157

FOREIGN PATENT DOCUMENTS

JP 06-54255 U 7/1994

* cited by examiner

*Primary Examiner*—Thanh-Tam T Le
(74) *Attorney, Agent, or Firm*—Barley Snyder LLC

(57) ABSTRACT

A connector having a first connector portion with a first connection interface and a guide projection is disclosed. The connector also has a second connector portion with a second connection interface configured for insertion into the first connection interface. The connector also has a lever having a guide channel configured to receive the guide projection. The lever is linearly movably connected to the second connector portion and is positionally biased away from the second connector portion. While the guide projection is within the guide channel, movement of the lever from a fully positionally biased location with respect to the second connector portion initiates a change in a state of connection between the first connector portion and the second connector portion.

14 Claims, 15 Drawing Sheets

CONNECTOR WITH AN ELASTIC LEVER

CROSS-REFERENCE TO RELATED APPLICATION DATA

This application claims the benefit of the earlier filed Korean Patent Application No. 10-2007-0014475 having a filing date of Feb. 12, 2007.

FIELD OF THE INVENTION

The present invention relates to a connector.

BACKGROUND

Generally, a connector functions to electrically connect separate parts of a circuit. Electrical connectors often comprise a cap and a plug as a pair. Electrical connectors are widely used to supply electric power to various machines and electronic appliances. Electrical connectors are also used to intermittently connect various electric operation signals with one another.

However, when connecting the cap to the plug of a conventional connector, an operator has to grip the cap and the plug using both hands and apply a great force to the cap and the plug in opposite directions. Therefore, connection of the cap and the plug is sometimes very laborious, especially when doing so within the confines of a small space.

To solve such problems, an elastic lever connector was introduced in Korean Patent No. 10-2007-0004929 filed by the present applicant, which is capable of forcibly connecting and separating the cap and the plug by a lever elastically moving with respect to a side of the plug.

The above elastic lever connector shown in Prior Art FIGS. 7 and 8 comprises a cap 100 and a plug 200. The cap 100 comprises a connection unit 101 having a connecting projection 102. The plug 200 to be connected with the connection unit 101 comprises a relative connection unit 201 corresponding to the connection unit 101, and a supporting spring 202 and a spring cap 203 formed at the inside thereof. The supporting spring 202 elastically supports a lever 300 that will be described hereinafter.

The lever 300 is mounted to one side of the plug 200 to reciprocate linearly. Since a connecting groove 301 is formed at the lever 300, the cap 100 and the plug 200 are forced to connect with and separate from each other while the connecting projection 102 is moving along an inside of the connecting groove 301. The lever 300 comprises a pressing projection 302 and a releasing projection 303 fixing and releasing the spring cap 203, respectively. By pressing projection 302 and the releasing projection 303, a repulsive force is generated while the lever 300 is being inserted in a plug housing, and the repulsive force is removed after the lever 300 is completely inserted in the plug housing, such that incomplete connection between the cap 100 and the plug 200 can be prevented.

However, according to the above conventional elastic lever connector, a lot of parts are required to dedicatedly form the spring cap 203 to the spring 202 and the pressing and releasing projections 302, 303 to the lever 300, thereby complicating the structure of the connector.

Furthermore, since a moving distance of the lever 300 is long in the conventional structure, it is hard to operate the lever 300 within the confines of a small space. Also, since connection between the cap 100 and the plug 200 is maintained by a force of the supporting spring 202, if a greater external force than the force of the supporting spring 202 is applied, the connection may be released.

SUMMARY

The present invention relates to, in one embodiment among others, a connector having a first connector portion with a first connection interface and a guide projection. The connector also has a second connector portion with a second connection interface configured for insertion into the first connection interface. The connector also has a lever having a guide channel configured to receive the guide projection. The lever is linearly movably connected to the second connector portion and is positionally biased away from the second connector portion. While the guide projection is within the guide channel, movement of the lever from a fully positionally biased location with respect to the second connector portion initiates a change in a state of connection between the first connector portion and the second connector portion.

BRIEF DESCRIPTION OF THE DRAWINGS

The above and other objects, features and other advantages of the present invention will be more clearly understood from the following detailed description taken in conjunction with the accompanying drawings, in which.

Prior Art

DETAILED DESCRIPTION OF THE EMBODIMENTS

Hereinafter, an exemplary embodiment of the present invention will be described in detail with reference to the accompanying drawings.

Figure 1:
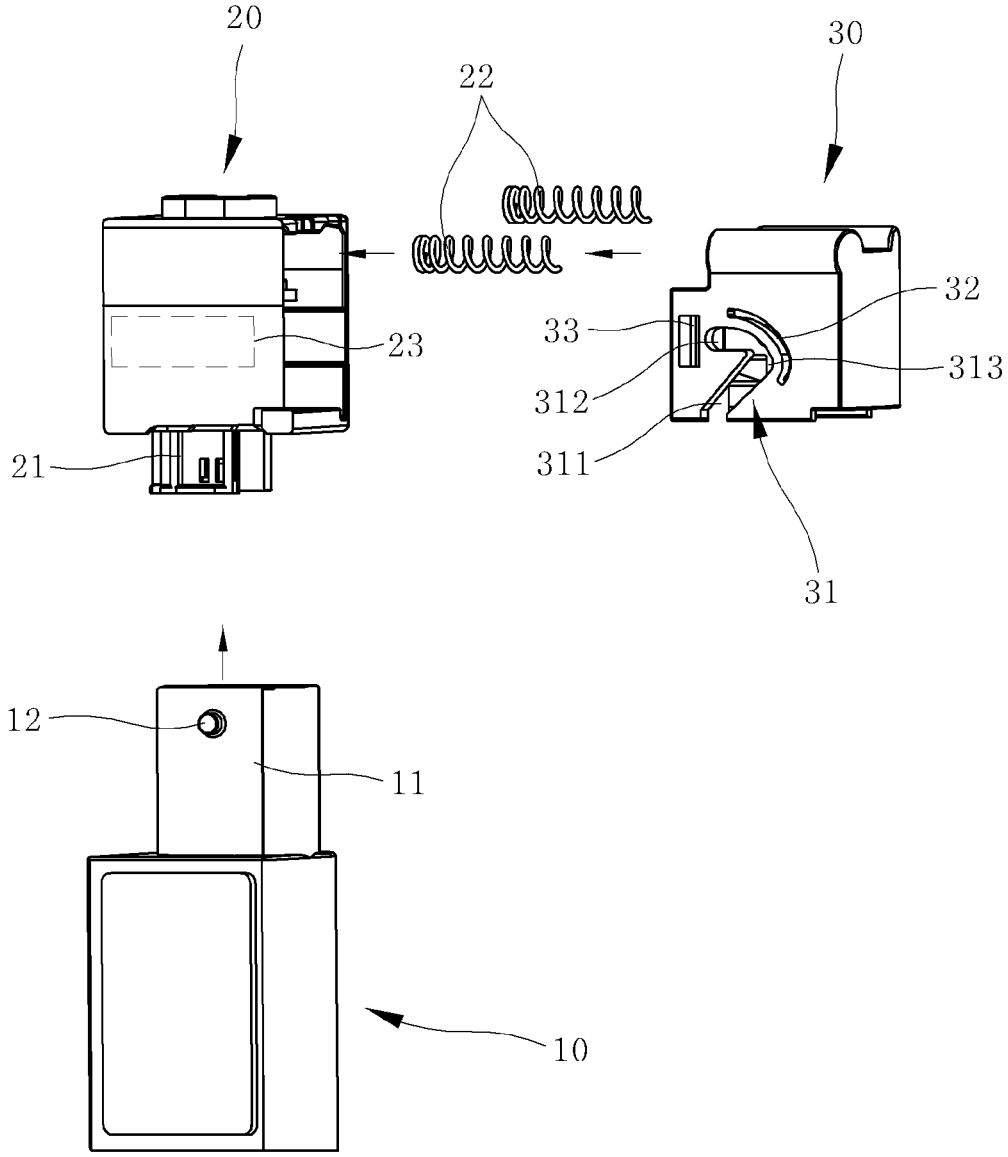
FIG. 1 is an exploded oblique view of a connector according to an embodiment of the present invention.
Figure 2:
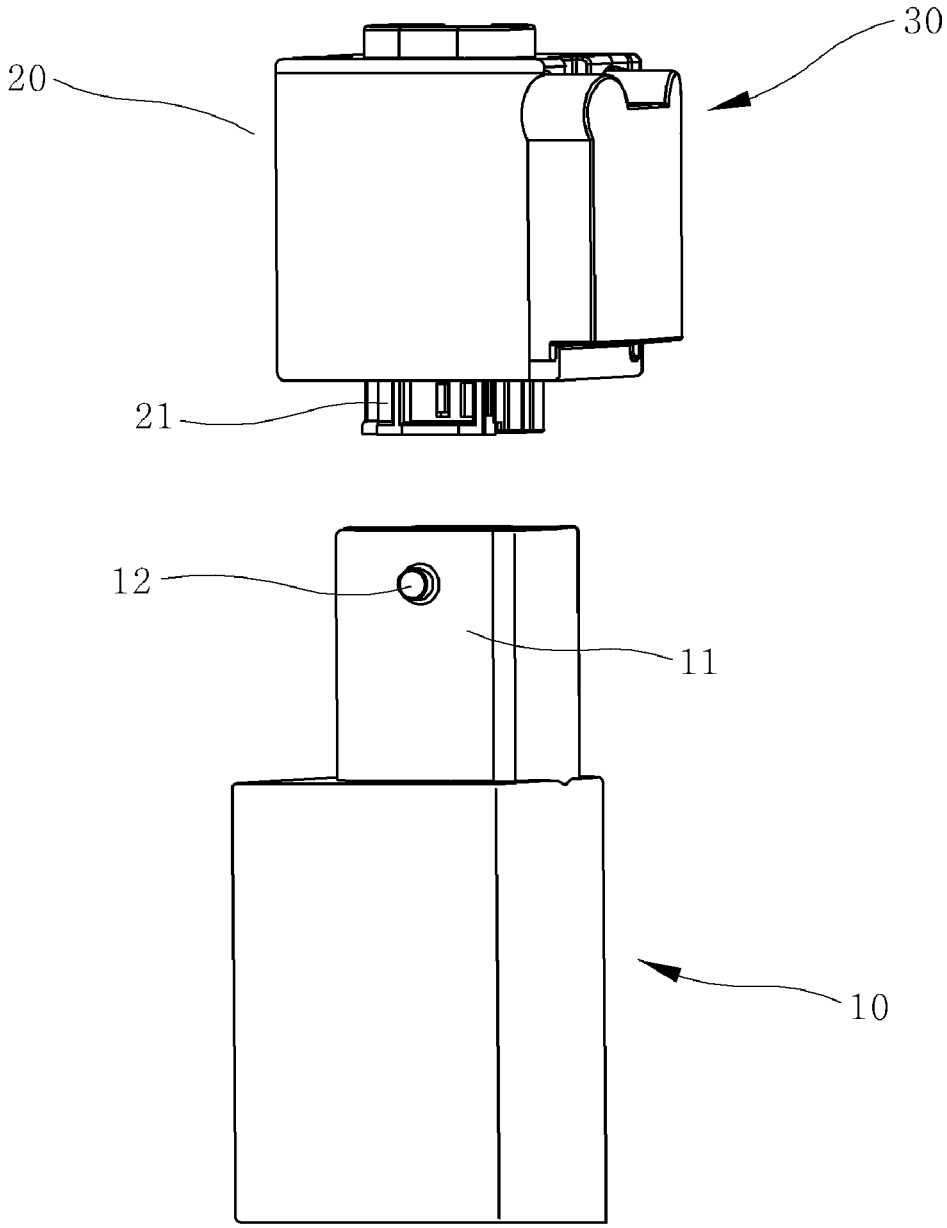
FIG. 2 is an oblique view of a partially assembled state of the connector of FIG. 1.

FIG. 1 is an exploded oblique view of a connector according to an embodiment of the present invention, and FIG. 2 is an oblique view showing the parts of the connector assembled. As shown in the drawings, the connector comprises a first connector portion 10 and a second connector portion 20. The connector may supply electric power or connect signals. The first connector portion 10 and the second connector portion 20 are connected to each other by being pushed correspondingly in opposite directions and toward each other, and separated as a lever 30 mounted to one side of the second connector portion 20 is pushed and therefore elastically moved opposite a direction in which the lever is biased.

The first connector portion 10 includes a first connection interface 11 inserted in the second connector portion 20, and a guide projection 12 formed on an outer surface of the first connection interface 11. The guide projection 12 moves in engagement with a guide channel 31 of the lever 30, so that the first connector portion 10 and the second connector portion 20 are forcibly separated from each other by the operation of the lever 30.

The second connector portion 20 may be a circuit module or a sensor containing a circuit module built therein.

The second connector portion 20 includes a second connection interface 21 at a lower part thereof so that the first connection interface 11 is inserted in the second connection interface 21 from the lower part. The lever 30 mounted to the one side of the second connector portion 20 is inserted into the second connector portion 20 and protrudes from the second connector portion 20. A supporting spring 22 is disposed inside the second connector portion 20 to press against an inner surface of the second connector portion 20 at one end of the spring 22 and press against the lever 30 at the other end of the spring 22. Therefore, the lever 30 can be biased to move away from the inner surface of the second connector portion 20.

The lever 30 is moved transversely with respect to the second connector portion 20. The guide channel 31 is formed on an outer surface of the lever 30 to insert the guide projection 12 therein and guide the movement of the guide projection 12. Therefore, when connecting the first connector portion 10 to the second connector portion 20, as the guide projection 12 moves along the guide channel 31, the lever 30 is transversely moved, being biased by the spring 22. To separate the first connector portion 10 from the second connector portion 20, the lever 30 is pushed toward the second connector portion 20 so that, as the guide projection 12 moves along the guide channel 31, the first connector portion 10 is forced out of the second connector portion 20 by the elasticity or spring bias provided by the spring 22.

The guide channel 31 comprises a first guide portion 311 formed at a lateral side of the lever 30 and the first guide portion 311 is has an open lower portion and, in this embodiment, is sloped upward and toward the portion of the lever 30 that protrudes from the second connector portion 20. A second guide portion 312 extends from near an upper end of the first guide portion 311 in a direction substantially horizontal and away from the portion of the lever 30 that protrudes from the second connector portion 20. The second guide portion 312 extends in a horizontal direction that is opposite from the horizontal directional component of the slope of the first guide portion 311 (when the slope direction is defined as originating at the open lower portion and extending toward the upper portion of the first guide portion 311). According to this structure, when the guide projection 12 is introduced in the second guide portion 312 after passing through the first guide portion 311 (or in the opposite case where the guide projection 12 is introduced into the first guide portion 311 after passing through the second guide portion 312), a force that is transmitted between the lever 30 and the spring 22 is changed.

In addition, a third guide portion 313 disposed between the first guide portion 311 with the second guide portion 312 has a gently curved inner surface for contact the guide projection 12 so that the guide projection 12 can smoothly transfer between the first guide portion 311 and the second guide portion 312.

Additionally, an adjustable hole 32 is formed through the lever 30 near an outer curve of the third guide portion 313 so that a width of the third guide portion 313 can be elastically varied. Accordingly, the guide projection 12 can be moved more smoothly.

The lever 30 and the second connector portion 20 include a retention projection 33 and a retention recess 23, respectively, on surfaces thereof contacting each other to prevent separation of the lever 30 and the second connector portion 20 when moving the lever 30 and the second connector portion 20 connected to each other. Therefore, the lever 30 is able to operate favorably without escaping from the second connector portion 20 in spite of the elastic movement thereof.

Figure 3A:
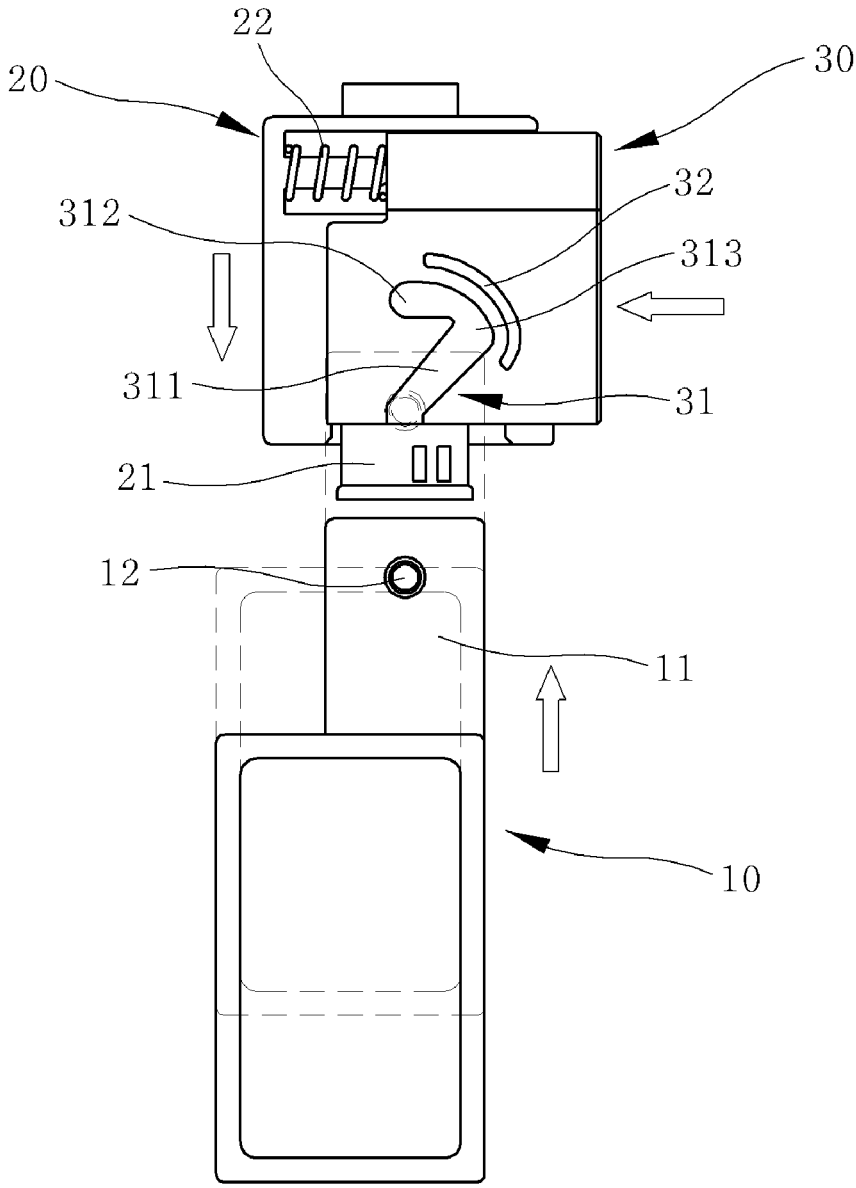
FIG. 3*a* is a front view of the connector of FIG. 1 before assembly.
Figure 3B:
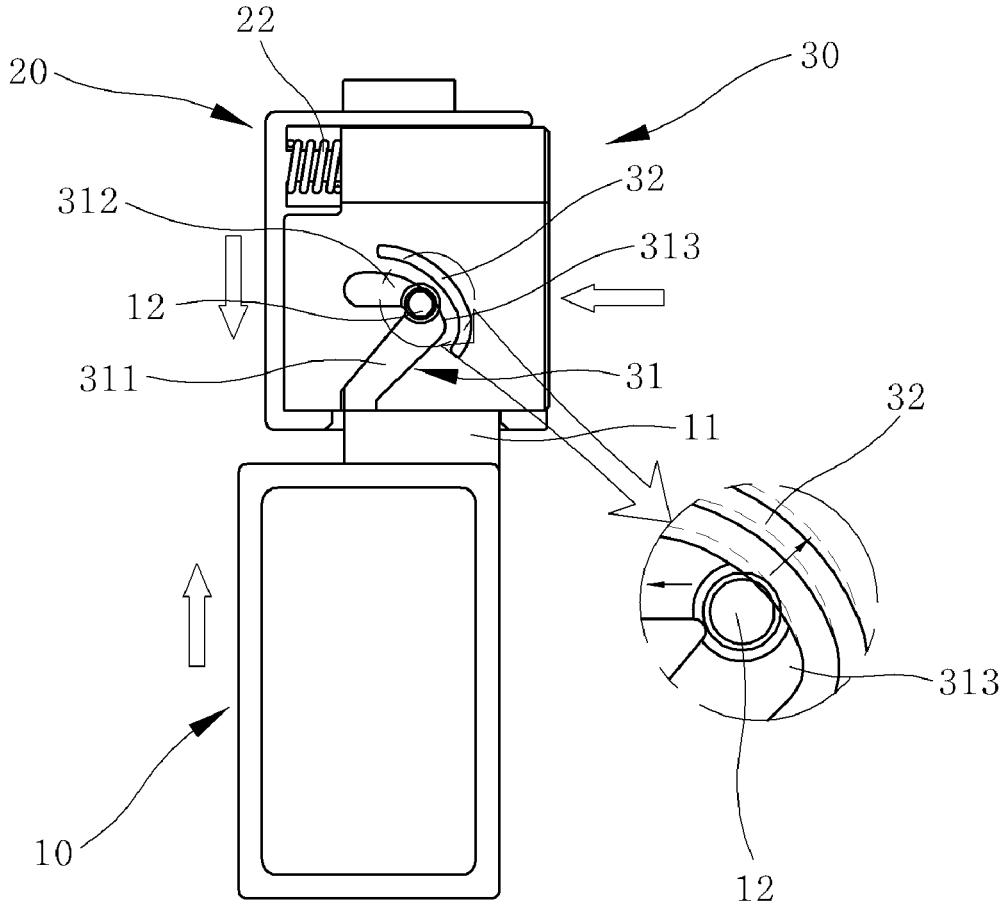
FIG. 3*b* is a front view of the connector of FIG. 1 during assembly.
Figure 3C:
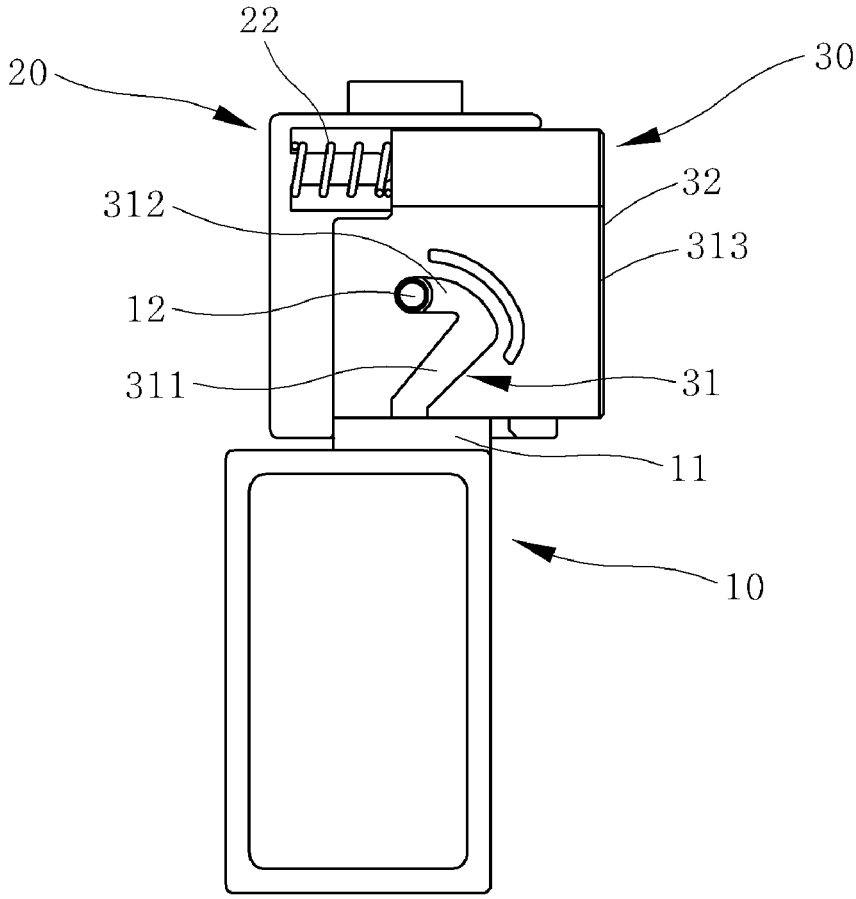
FIG. 3*c* is a front view of the connector of FIG. 1 after assembly.

FIGS. 3*a*-3*c* illustrate an assembly processes of the connector according to an embodiment of the present invention. More specifically, FIG. 3*a* is a front view of the connector before assembly, FIG. 3*b* is a front view of the connector during assembly, and FIG. 3*c* is a front view of the connector after assembly. As shown in FIG. 3*a* first, when the first connector portion 10 and the second connector portion 20 are connected, the first connection interface 11 corresponds to and is inserted in the second connection interface 21. Then, by pushing the first connector portion 10 and the second connector portion 20 toward each other, the guide projection 12 is inserted in a lower part of the first connecting groove 311 and moved along the first guide portion 311. Thereby, the lever 30 is moved toward the second connector portion 20 by an engaging force between the first connector portion 10 and the second connector portion 20.

When the guide projection 12 reaches the third guide portion 313 as shown in FIG. 3*b*, the lever 30 is moved into the second connector portion 20 as far as possible and therefore, elastic compression of the spring 22 supporting the lever 30 is maximized.

Since the inner surface of the third guide portion 313 is curved, the third guide portion 313 has a smaller width than the first and second guide portions 311 and 312. To allow smooth movement of the guide projection 12 through the third guide portion 313, the adjustable hole 32 is formed near the outer curve of the third guide portion 313 to elastically vary the width of the third guide portion 313. According to this, the operator can easily connect the first connector portion 10 with the second connector portion 20 without applying further force while the guide projection 12 is within the third guide portion 313.

When the first connector portion 10 and the second connector portion 20 are further pushed, the guide projection 12 being moved through the third guide portion 313 moves to the second guide portion 312 as shown in FIG. 3*c*. In this state, the force of the guide projection 12 supporting the lever 30 is removed and therefore, the lever 30 is pushed out of the second connector portion 20 by elasticity of the spring 22, thereby moving to an initial position. Thus, connection between the first connector portion 10 and the second connector portion 20 is completed.

Therefore, an operator can ensure completion of the connection through tactile sensation and by visually confirming that the lever 30 is returned to the initial position. As a result, incomplete connection between the first connector portion 10 and the second connector portion 20 can be prevented. Furthermore, since the second guide portion 312 secures the guide projection 12 in a direction of separating the first connector portion 10 and the second connector portion 20 from each other, separation between the first connector portion 10 and the second connector portion 20 due to an external impact or vibration can also be prevented.

Figure 4A:
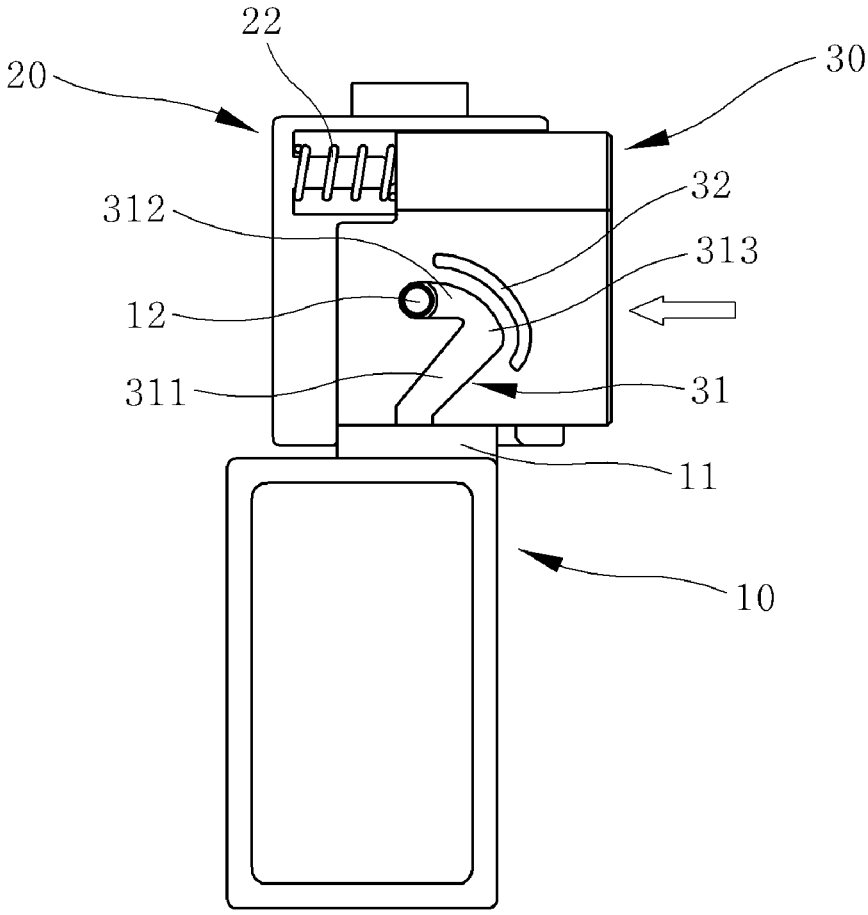
FIG. 4*a* is a front view of the connector of FIG. 1 before disassembly and showing an initial pushed state of a lever.
Figure 4B:
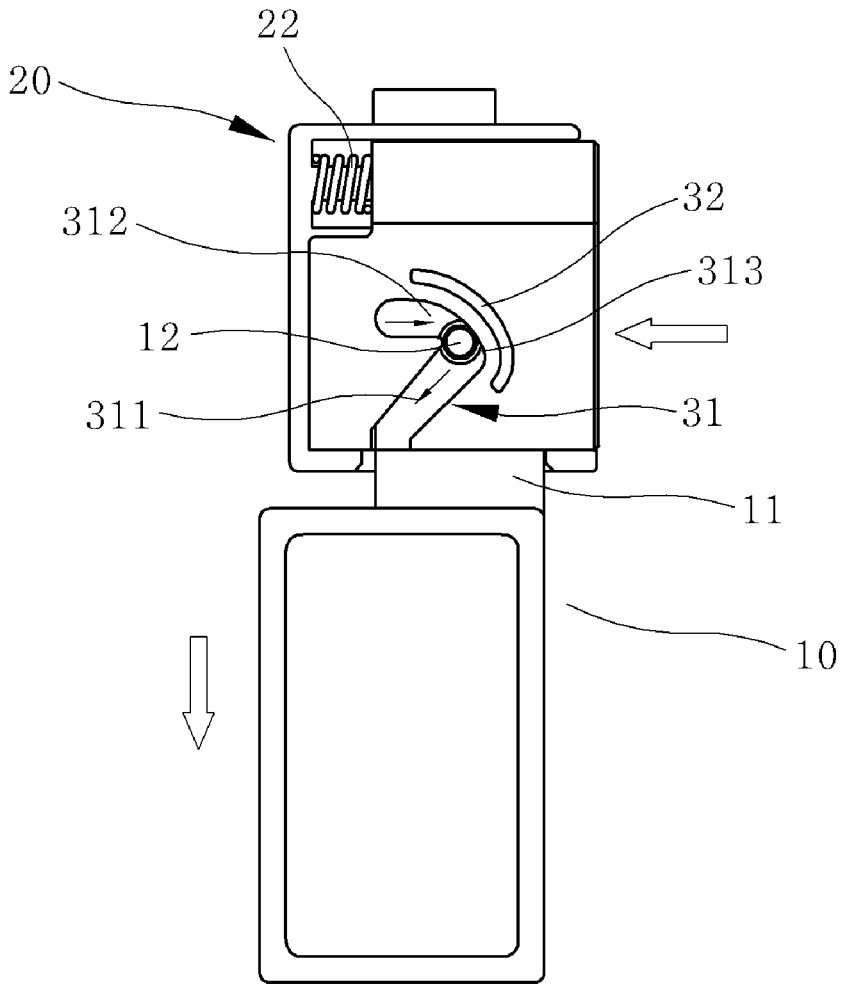
FIG. 4*b* is a front view of the connector of FIG. 1 during disassembly and showing a final pushed state of the lever.
Figure 4C:
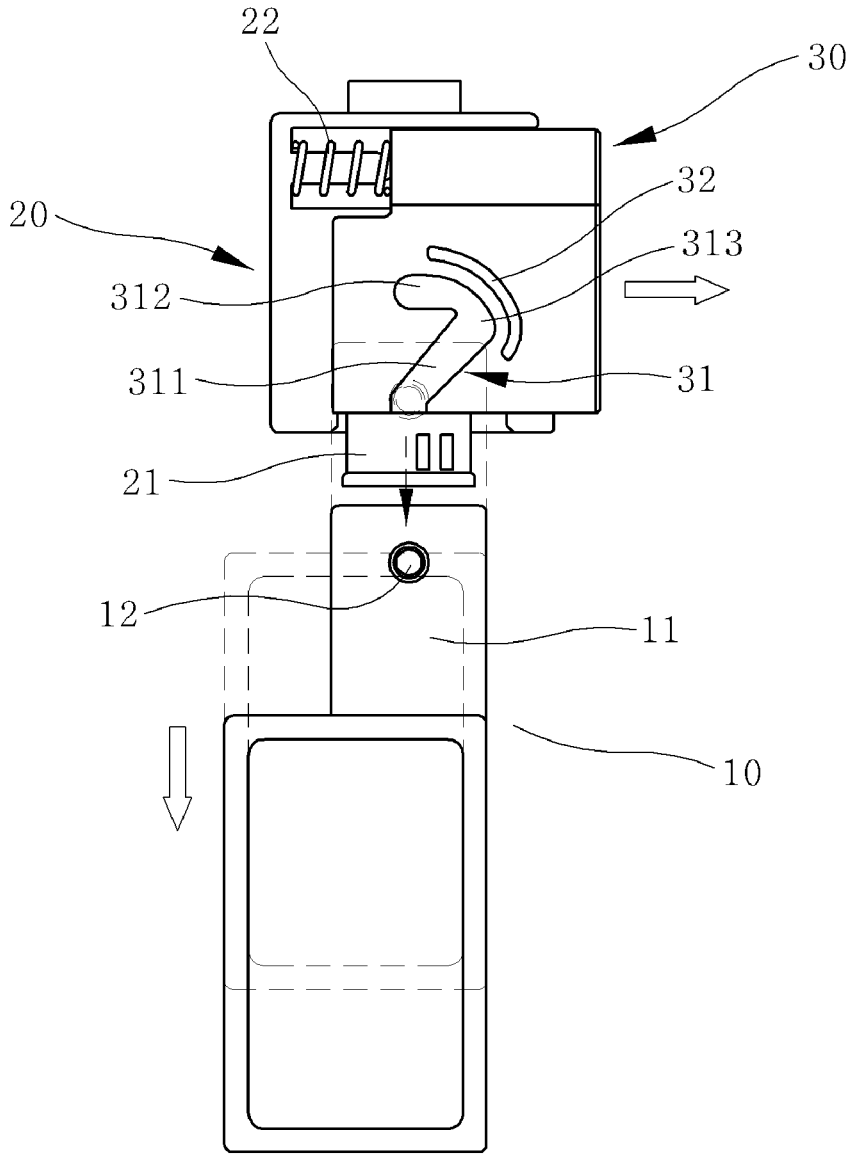
FIG. 4*c* is a front view of the connector of FIG. 1 in a disassembled state.

FIGS. 4*a*-4*c* illustrate a disassembly process of the connector according to the embodiment of FIG. 3*a*. More specifically, FIG. 4*a* is a front view showing an initial pushed state of the lever 30, FIG. 4*b* is a front view showing a final pushed state of the lever 30, and FIG. 4*c* is a front view of the connector in a disassembled state. To separate the first connector portion 10 from the second connector portion 20, the lever 30 is pushed inwardly of the second connector portion 20 first as shown in FIG. 4*a*. Then, as the second guide portion 312 moves relative to the guide projection 12, the lever 30 compresses the spring 22, thereby increasing the elastic force of the spring 22.

Next, when the lever 30 is pushed into the second connector portion 20 as far as possible as shown in FIG. 4*b*, the guide projection 12 reaches the third guide portion 313 and slides down along the inner surface of the third guide portion 313. Simultaneously, the first connector portion 10 and the second connector portion 20 are gradually separated from each other.

While the guide projection 12 passes through the third guide portion 313 as well, the width of the third guide portion 313 is elastically increased by the existence of the adjustable hole 32 so that the guide projection 12 can be smoothly moved. Moreover, because an elastic restoring force of the third guide portion 313 by the adjustable hole 32 pushes the guide projection 12 downward of the second connector portion 20, the guide projection 12 can be smoothly slid down by pushing the lever 30 with a minor force.

After passing through the third guide portion 313 as shown in FIG. 4*c*, the guide projection 12 is moved along the first guide portion 311. In this state, as the lever 30 is pushed out of the second connector portion 20 by the elastic force of the spring 22, the guide projection 12 is pushed downward of the second connector portion 20 so that the first connector portion 10 and the second connector portion 20 are completely separated from each other.

Figure 5A:
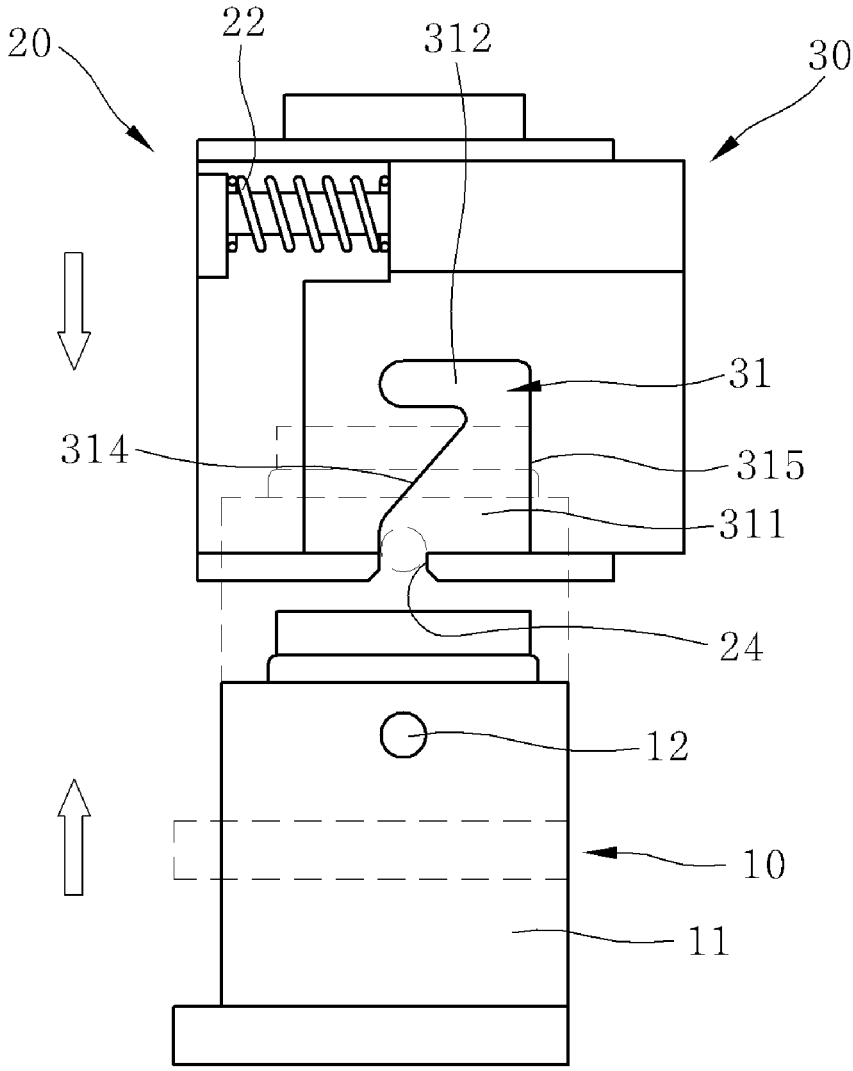
FIG. 5*a* is a front view of a connector according to another embodiment of the present invention showing the connector before assembly.
Figure 5B:
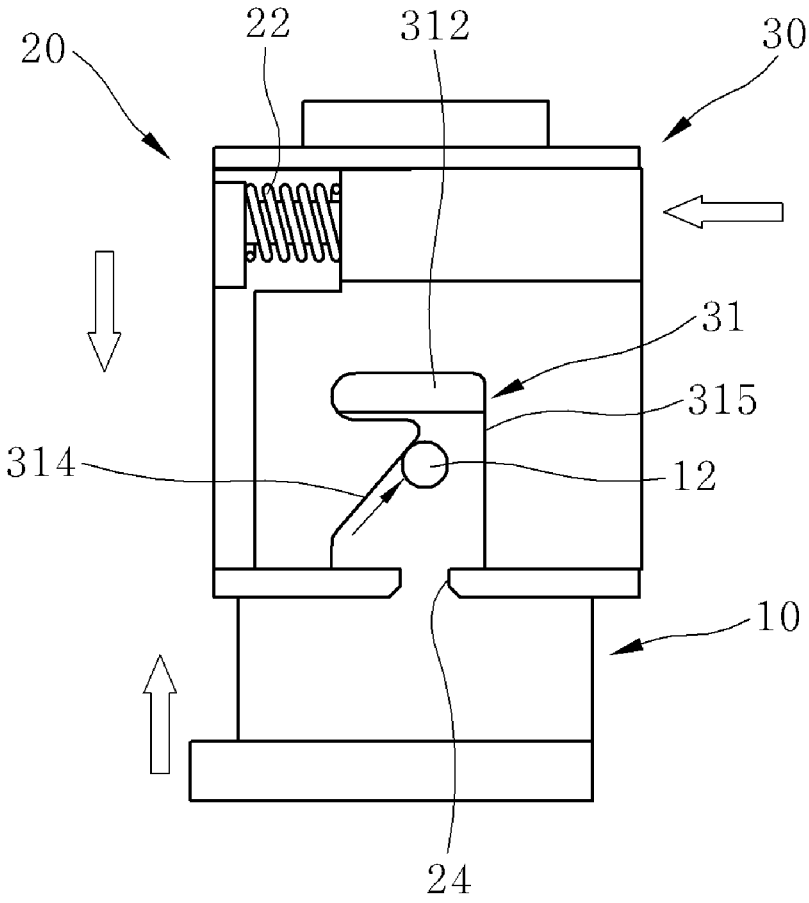
FIG. 5*b* is a front view of the connector of FIG. 5*a* during assembly.
Figure 5C:
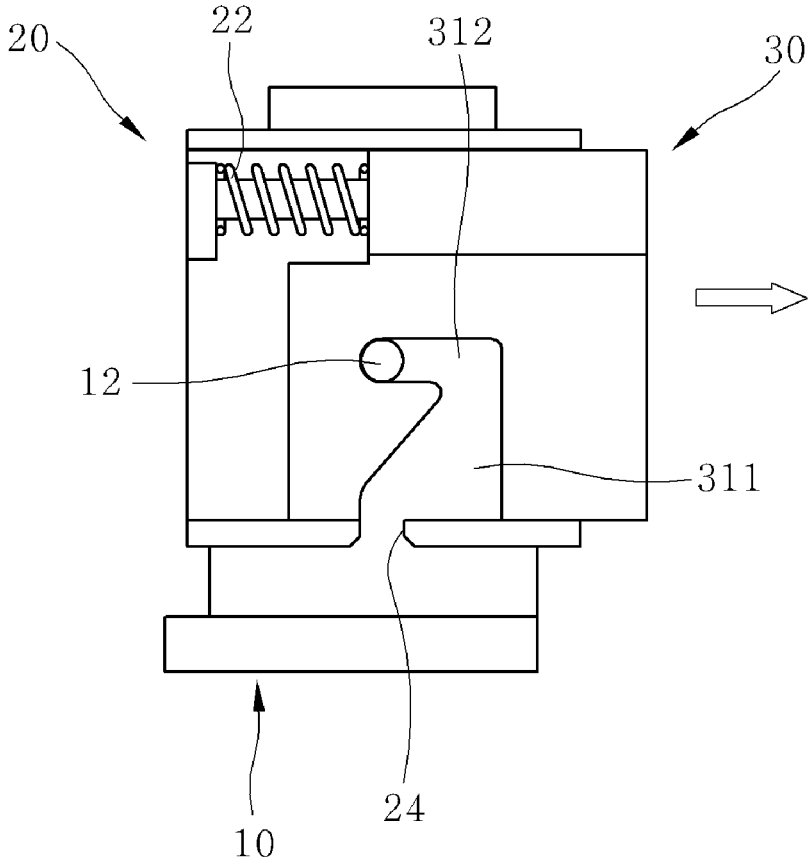
FIG. 5*c* is a front view of the connector of FIG. 5*a* after assembly.

FIGS. 5*a*-5*c* illustrate an assembly process of a connector according to another embodiment of the present invention. More specifically, FIG. 5*a* is a front view of the connector before assembly, FIG. 5*b* is a front view of the connector during assembly, and FIG. 5*c* is a front view of the connector after assembly. In this embodiment, a guide channel opening 24 is formed at a lower center of the second connector portion 20 to allow insertion and separation of the guide projection 12 therethrough. The guide channel 31 having the first and second guide portions 311 and 312 are formed on the outer surface of the lever 30.

A width of the first guide portion 311 is configured so that a lower part of the first guide portion 311 is in fluid communication with the guide channel opening 24 whether the lever 30 is maximally inserted in the second connector portion 20 or separated from the second connector portion 20. The first guide portion 311 comprises a sloped side 314 formed upward on an inner surface thereof that corresponds to the guide channel opening 24 in a state where the lever 30 maximally protrudes from the second connector portion 20 in a fully positionally biased position. A vertical side 315 is formed on the opposite inner surface to the sloped side 314. Thus, the first guide portion 311 is wide at the lower part and narrow at the upper part. The second guide portion 312 is extended horizontally from an upper end of the first guide portion 311.

The guide channel opening 24 is formed at the lower part of the second connector portion 20 in a vertical direction such that the guide projection 12 formed on an outer surface of the first connector portion 10 is able to be smoothly inserted in and separated from the guide channel 31 of the lever 30 through the guide channel opening 24. The second guide portion 312 extended from the first guide portion 311 is directed to the sloped side 314.

According to the above structure, to connect the first connector portion 10 with the second connector portion 20, the first connector portion 10 and the second connector portion 20 are pushed correspondingly toward each other as shown in FIG. 5*a* so that the guide projection 12 formed at the first connector portion 10 is inserted in the guide channel 31 of the lever 30 through the guide channel opening 24.

Next, when the first connector portion 10 and the second connector portion 20 are further pushed toward each other as shown in FIG. 5*b*, the guide projection 12 is moved along the sloped side 314 as the first connector portion 10 is pushed into the second connector portion 20. Accordingly, the lever 30 is pushed into the second connector portion 20.

When the connection is completed, the guide projection 12 is disposed at the second guide portion 312 as shown in FIG. 5*c*. Simultaneously, the lever 30 is pushed to the initial position by the elastic force of the spring 22 that elastically supports the lever 30.

When the lever 30 is pushed completely out, the guide projection 12 is disposed at an inner end of the second guide portion 312. In this state, movement of the guide projection 12 is thoroughly restricted to vertical directions. As a result, the first connector portion 10 and the second connector portion 20 are not easily separated by external impacts or vibrations.

The guide channel opening 24 may be formed at the lower part of the second connector portion 20 for a precise connection between the first connector portion 10 and the second connector portion 20 and a favorable linear motion of the lever 30. However, since the present invention is not limited to have such a structure, the guide channel opening 24 may be omitted and a lower opened part of the second guide portion 312 may be exposed directly to the lower part of the second connector portion 20.

Figure 6A:
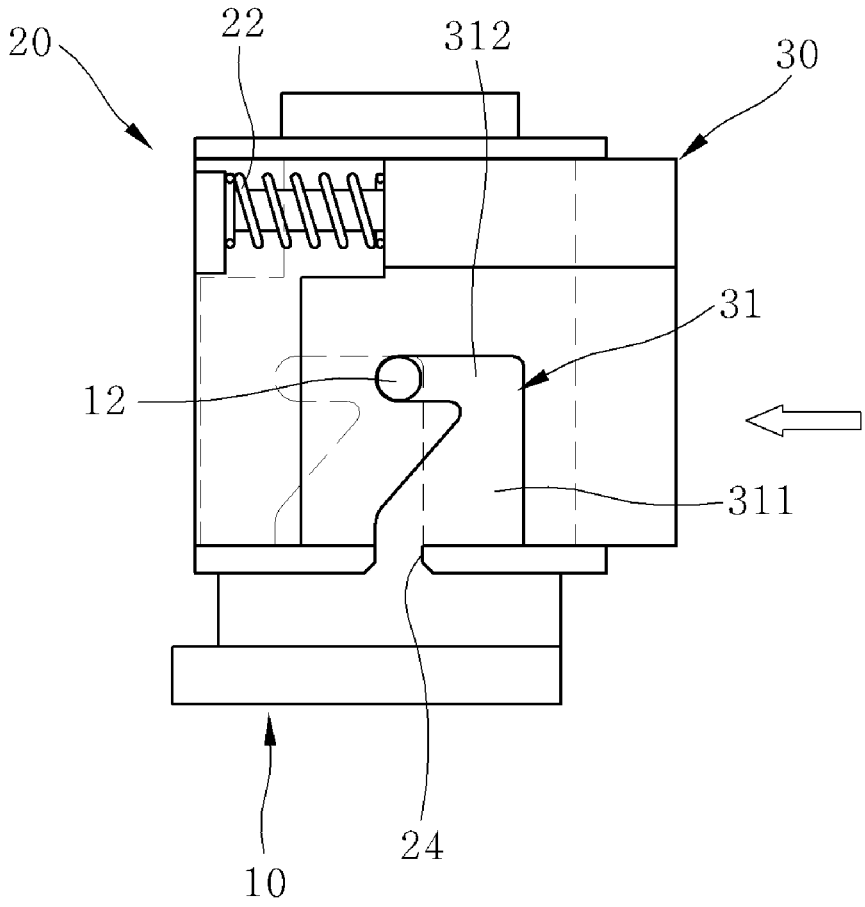
FIG. 6*a* is a front view of the connector of FIG. 5*a* showing a state of the connector prior to disassembly.
Figure 6B:
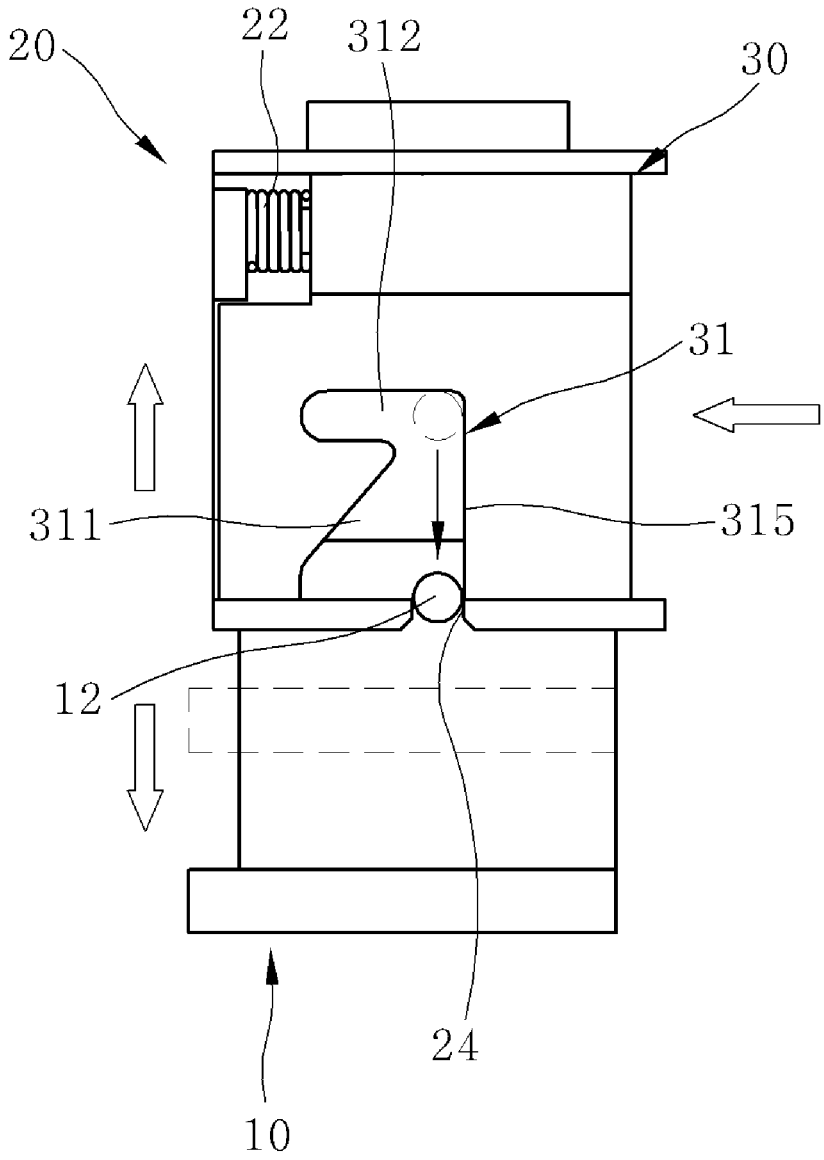
FIG. 6*b* is a front view of the connector of FIG. 5*a* in a disassembled state.
Figure 7:
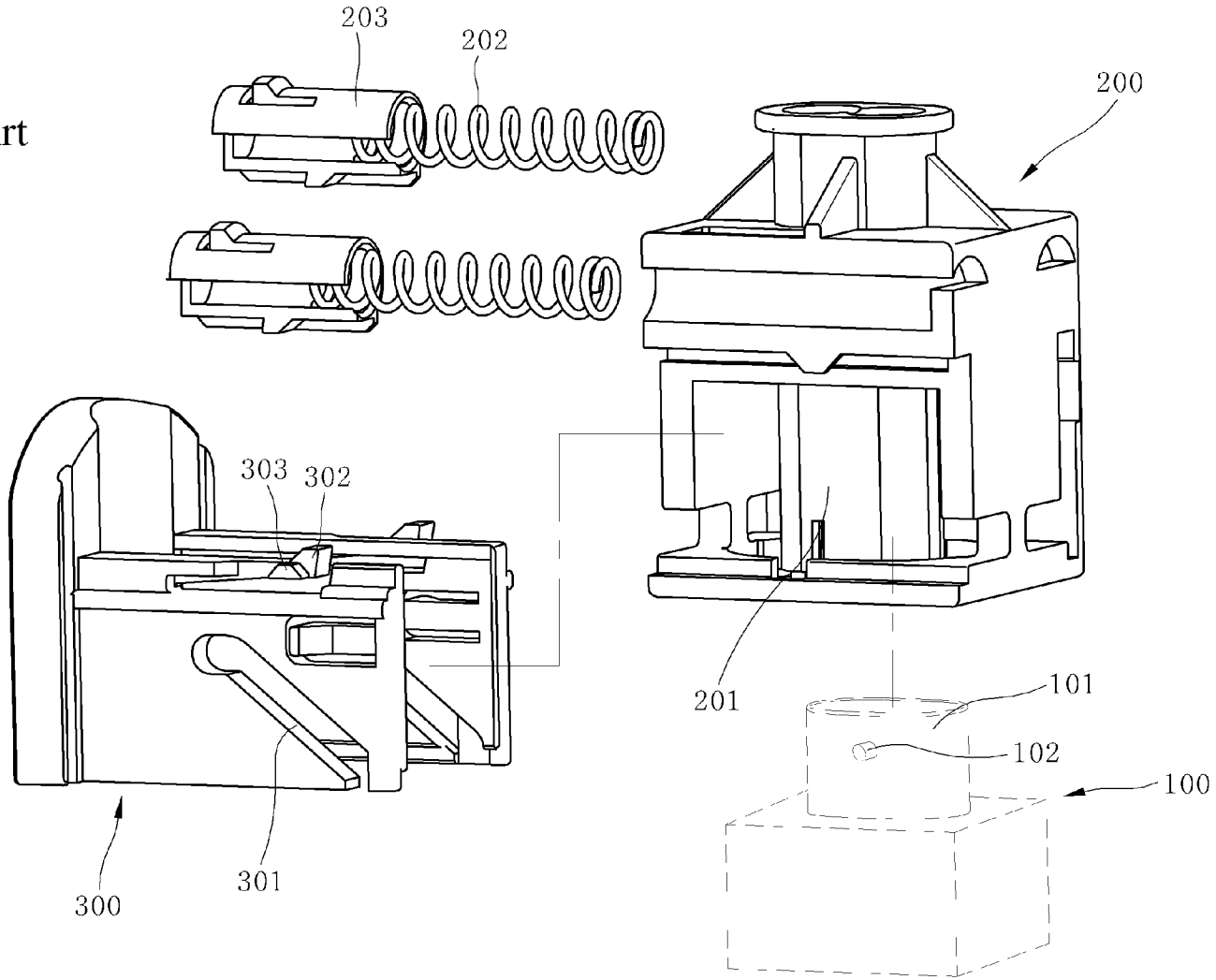
Fig. 7 Prior Art
FIG. 7 is an exploded oblique view of a conventional elastic lever connector; and Prior Art
Figure 8:
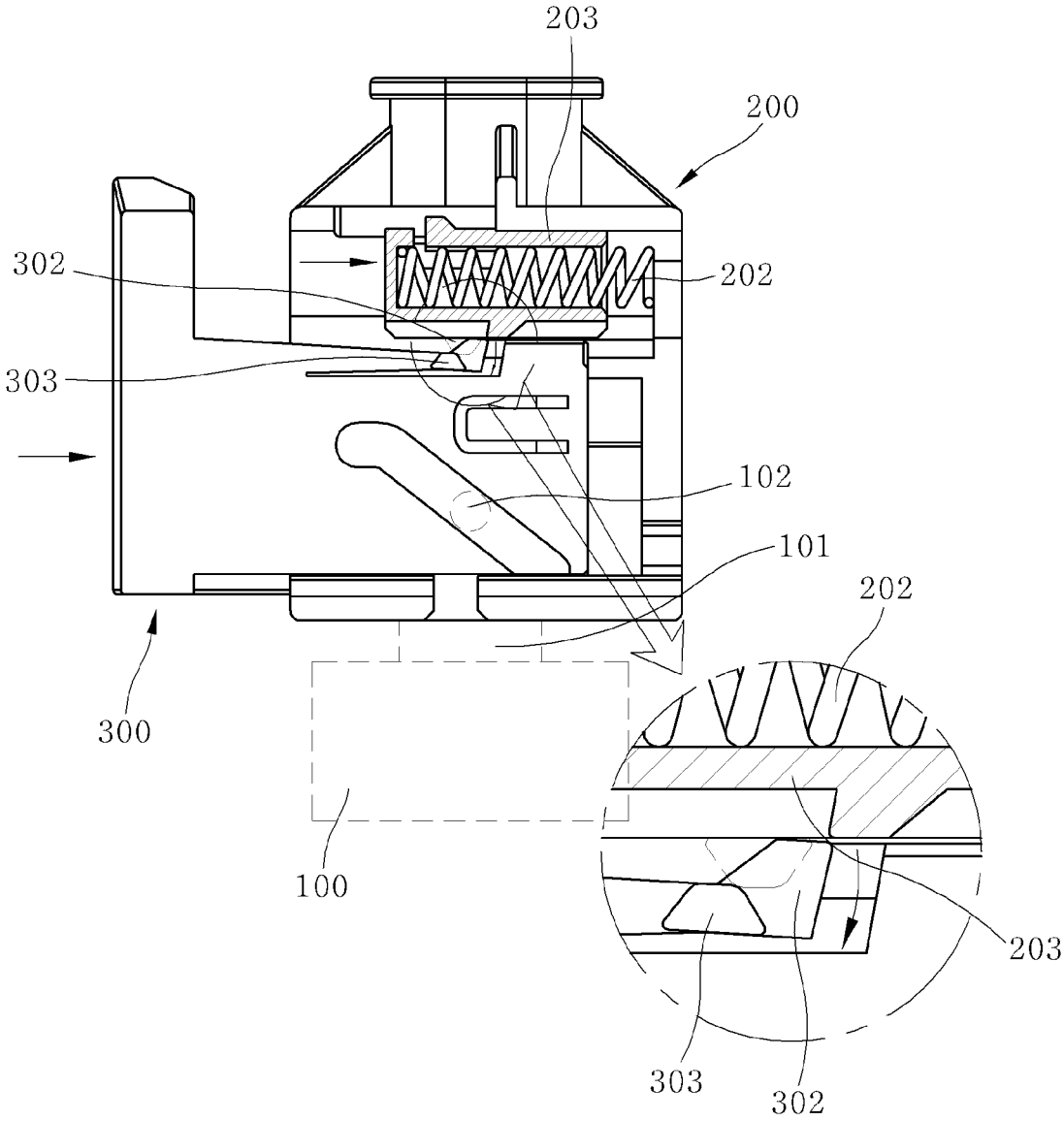
Fig.8 Prior Art
FIG. 8 is an orthogonal view of the conventional elastic lever connector of FIG. 7.

FIGS. 6*a*-6*b* illustrate a disassembly processes of the connector according to the embodiment of FIG. 5*a*. More specifically, FIG. 6*a* is a front view showing a pushed state of a lever 30 and FIG. 6*b* is a front view of the connector in a disassembled state. To separate the first connector portion 10 from the second connector portion 20, first, the lever 30 is pushed into the second connector portion 20 as shown in FIG. 6*a*. Therefore, the guide projection 12 is moved along the second guide portion 312 up to a linking part between the first and second guide portions 311 and 312.

Accordingly, in this state, the guide channel opening 24 is disposed under the guide projection 12. By pulling out the first connector portion 10 and the second connector portion 20 in opposite directions with the lever 30 pushed as shown in FIG. 6*b*, the guide projection 12 can be separated conveniently from the lever 30 and the second connector portion 20 without being obstructed.

Moreover, an engaging force among terminals in the first connector portion 10 and the second connector portion 20 prevents dropping of the first connector portion 10.

When the operator releases the pushed lever 30 without pulling the first connector portion 10 and the second connector portion 20 in the opposite directions, the lever 30 returns to the initial position due to the elastic force of the spring 22 so that the first connector portion 10 and the second connector portion 20 are reconnected. Thus, undesired separation between the first connector portion 10 and the second connector portion 20 by malfunction of the lever 30 can be prevented.

In addition, if the force pushing the lever 30 is removed after the first connector portion 10 and the second connector portion 20 are completely separated, the lever 30 returns to the initial position due to the elastic force of the spring 22. Therefore, repetitive connection and separation of the first connector portion 10 with the second connector portion 20 can be achieved with convenience.

As can be appreciated from the above description, an connector according to the embodiment of the present invention enables more secure connection and convenient separation between a first connector portion 10 and a second connector portion 20 thereof, while preventing undesired separation between the first connector portion 10 and a second connector portion 20 due to an external impact. Consequently, the connector is capable of performing power supply and signal connections stably and constantly. Furthermore, connection and separation between the first connector portion 10 and a second connector portion 20 can be performed more easily and precisely, and can be clearly confirmed by the operator through the operator's tactile and auditory sensation.

In addition, since a guide channel 31 engaged with a guide projection 12 is divided into first and second guide portions 311 and 312, the lever can be elastically moved in accordance with a shape of the guide channel 31, thereby conveniently separating the first connector portion 10 and a second connector portion 20. Also, since an operational distance of the lever 30 for separating the first connector portion 10 and a second connector portion 20 is greatly reduced, assembly and disassembly of the connector can be achieved even in a small space. Furthermore, while maintaining the preciseness of connection and separation between the first connector portion 10 and a second connector portion 20, the number of parts of the lever 30 and the connector can be minimized, accordingly simplifying the manufacture of the connector.

According to the embodiment of the present invention, the third guide portion 313 between the first and second guide portions 311 and 312 is curved so that the guide projection 12 is more smoothly moved during separation and connection of the first connector portion 10 and the second connector portion 20, thereby reducing and more uniformly distributing a force required for the connection and the separation.

Furthermore, since an adjustable hole 32 provides an enough space for the guide projection 12 to pass through the third guide portion 313 between the first and second guide portions 311 and 312, movement of the guide projection 12 can be more smoothly performed.

Although the embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A connector comprising:

a first connector portion having a first connection interface and a guide projection;

a second connector portion having a second connection interface configured for receiving the first connection interface;

a lever having a guide channel configured to receive the guide projection, the lever being linearly movably connected to the second connector portion and positionally biased away from the second connector portion;

a first guide portion of the guide channel formed in an outer surface of the lever;

a second guide portion of the guide channel that extends horizontally from an upper end of the first guide portion in a direction opposite to the direction in which the lever is positionally biased;

an opening of the first guide portion configured to receive the guide projection therethrough and into the first guide portion;

a spring disposed between the second connector portion and the lever;

wherein, while the guide projection is within the guide channel, movement of the lever from a fully positionally biased location with respect to the second connector portion initiates a change in a state of connection between the first connector portion and the second connector portion;

wherein the first guide portion extends sloped upward and away from the first connector portion and toward a direction in which the lever is positionally biased.

2. The connector according to claim 1, wherein the first connector portion and the second connector portion are connected in a direction substantially orthogonal to the direction in which the lever is positionally biased with respect to the second connector portion.

3. The connector according to claim 1, the second connector portion further comprising:

a guide channel opening formed at a lower center of the second connector portion, the guide channel opening being configured to allow passage of the guide projection therethrough and into the guide channel.

4. The connector according to claim 3, wherein the guide channel opening has a width substantially equal to a diameter of the guide projection.

5. The connector according to claim 4, the guide channel comprising:

a first guide portion configured for alignment with the guide channel opening.

6. The connector according to claim 5, wherein the first guide portion is aligned with the guide channel opening when the lever is maximally inserted into the second connector portion.

7. The connector according to claim 5, wherein the first guide portion is aligned with the guide channel opening when the lever is in a fully positionally biased position.

8. The connector according to claim 7, wherein the first guide portion is aligned with the guide channel opening when the lever is maximally inserted into the second connector portion.

9. The connector according to claim 8, the first guide portion further comprising:

a sloped side;

wherein, when the lever is in the fully positionally biased position, a lower end of the sloped side is substantially aligned with a first side of the guide channel opening.

10. The connector according to claim 9, the first guide portion further comprising:

a vertical side substantially opposite the sloped side;

wherein, when the lever is maximally inserted into the second connector portion, a lower end of the vertical side is substantially aligned with a second side of the guide channel opening that opposes the first side of the guide channel opening.

11. The connector according to claim 10, wherein a lower part of the first guide portion is wider than an upper part of the first guiding portion.

12. The connector according to claim 11, the guide channel further comprising:

a second guide portion that extends horizontally from an upper end of the first guide portion.

13. The connector according to claim 12, wherein the second guide portion extends from the first guide portion in a direction opposite to the direction in which the lever is positionally biased.

14. A connector comprising:

a first connector portion having a first connection interface and a guide projection;

a second connector portion having a second connection interface configured for receiving the first connection interface;

a lever having a guide channel configured to receive the guide projection, the lever being linearly movably connected to the second connector portion and positionally biased away from the second connector portion;

a first guide portion of the guide channel formed in an outer surface of the lever, the first guide portion having a sloped side formed upward on an inner surface and a vertical side formed on the opposite inner surface to the sloped side with a lower part of the first guide portion prepared wider than an upper part of the first guiding portion;

a second guide portion of the guide channel that extends horizontally from an upper end of the first guide portion in a direction opposite to the direction in which the lever is positionally biased;

an opening of the first guide portion configured to receive the guide projection therethrough and into the first guide portion;

wherein, while the guide projection is within the guide channel, movement of the lever from a fully positionally biased location with respect to the second connector portion initiates a change in a state of connection between the first connector portion and the second connector portion.

* * * * *